United States Patent [19]

Sillars

[11] Patent Number: 4,884,504

[45] Date of Patent: Dec. 5, 1989

[54] METHOD FOR PRINTING OF QUASI RANDOM NUMBER TABLES ON CYLINDRICAL OBJECTS

[76] Inventor: Ian Sillars, 2704 The Strand, Manhattan Beach, Calif. 90266

[21] Appl. No.: 142,155

[22] Filed: Jan. 11, 1988

[30] Foreign Application Priority Data

Aug. 14, 1987 [AU] Australia ..... PI3740

[51] Int. Cl.[4] ..... B41F 17/22; G07F 7/00

[52] U.S. Cl. ..... 101/483; 101/38.1; 101/76; 194/205; 273/138 A

[58] Field of Search ..... 101/DIG. 27, 216, 217, 101/218, 219, 232, 426, 38 R, 38 A, 39, 40, 76, 77, 91, 92, 483, 38.1; 194/205, 209, 210, 212, 213; 273/138 A, 1 E

[56] References Cited

U.S. PATENT DOCUMENTS

| | | | |
|---|---|---|---|
| 2,660,111 | 11/1953 | Herrick et al. | 101/217 X |
| 2,788,738 | 4/1957 | Wood | 101/171 |
| 3,250,213 | 5/1966 | Brigham et al. | 101/40 |
| 3,348,478 | 10/1967 | Gancarz et al. | 101/76 X |
| 3,521,554 | 7/1970 | Zurick | 101/40 |
| 3,593,661 | 7/1971 | Tripp | 101/40 X |
| 4,541,333 | 9/1985 | Sillars | 101/142 X |
| 4,542,688 | 9/1985 | Bohan | 273/138 A X |
| 4,573,954 | 3/1986 | Berger et al. | 273/138 A X |
| 4,628,816 | 12/1986 | Six | 101/76 X |
| 4,653,627 | 3/1987 | Hampson et al. | 194/209 |

FOREIGN PATENT DOCUMENTS

| | | | |
|---|---|---|---|
| 1577451 | 8/1969 | France | 101/DIG. 27 |
| 2107250 | 4/1983 | United Kingdom | 101/76 |

*Primary Examiner*—Clifford D. Crowder
*Attorney, Agent, or Firm*—Hecker & Harriman

[57] ABSTRACT

A method for printing quasi-random number tables on cylindrical objects. A quasi random number printing unit is inserted in a blanket cylinder of an object decorator press. A printing plate cylinder disposed within the printing unit is advanced by a cam drive, thereby advancing a plurality of belts entrained about the cylinder and exposing a series of printing plates to an inking unit. Ink is applied from the inking unit to a series of numerical segements on the plates, and from the segments to a cylindrical object surface.

6 Claims, 6 Drawing Sheets

METHOD FOR PRINTING OF QUASI RANDOM NUMBER TABLES ON CYLINDRICAL OBJECTS

BACKGROUND OF THE INVENTION

1. Field of the Present Invention

This invention relates to apparatus for printing quasi random numbers on cylindrical objects and has been devised particularly though not solely for printing random number tables for games of change onto cylindrical objects such as drink cans.

2. Background Art

Drink cans and other cylindrical objects such as paper cups, cardboard tubes, etc. are commonly printed with multiple colour graphics on cylindrical container decorating presses. With printing of this type it has hitherto proven impossible to print quasi random number tables of the type used in games of chance and utilized for promotional purposes onto the surface of the can or other cylindrical object. Various ways of printing random numbers onto cans have hitherto been incompatible with the cylindrical container decorating press and random numbers have had to be printed onto the can in a separate printing operation which is of course time consuming and expensive. To overcome this problem I have devised a way of utilizing a belt type apparatus for printing quasi random number tables.

SUMMARY OF THE PRESENT INVENTION

The present invention therefore provides apparatus for printing quasi random numbers on cylindrical objects, comprising a cylindrical container decorating printing press having a blanket cylinder incorporating a plurality of segments on which rubber offset blankets are mounted, characterized by the provision of a random number printing unit located between two segments within the blanket cylinder and arranged with the imprinting face of the unit aligned with the printing face of the adjacent blankets. Preferably a plurality of printing units are provided, one located between each pair of adjacent segments.

Preferably each random number printing unit comprises a unit comprising a plurality of unequal length belts entrained about a printing plate cylinder and an idler cylinder, each belt having a length which is a multiple of a basic pitch value or gradient, and having a plurality of printing plates adhered to its outer surface, the printing plate cylinder being driven by a cam to advance the belts one gradient between each printing pass.

DETAILED DESCRIPTION OF THE PRESENT INVENTION

Figure 1:
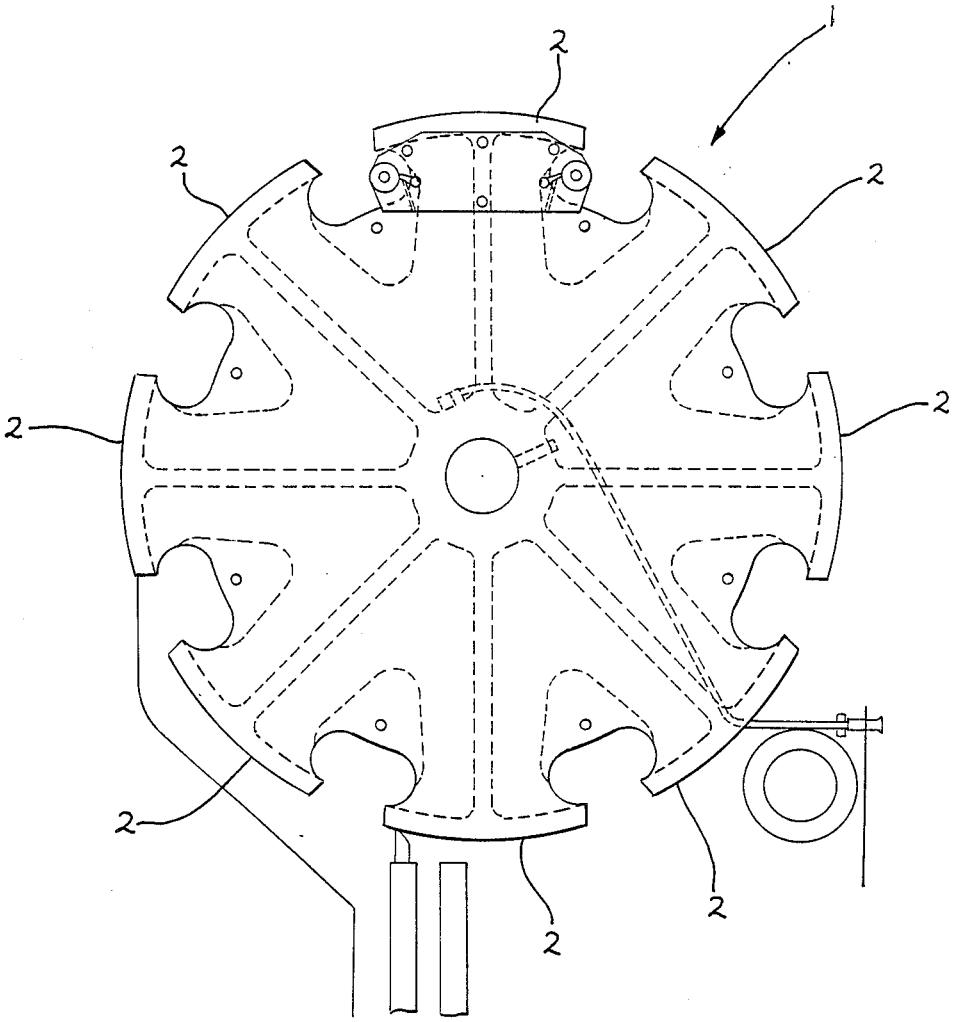
FIG. 1 is a diagrammatic view of the blanket cylinder of a conventional cylindrical container decorating press.
Figure 2:
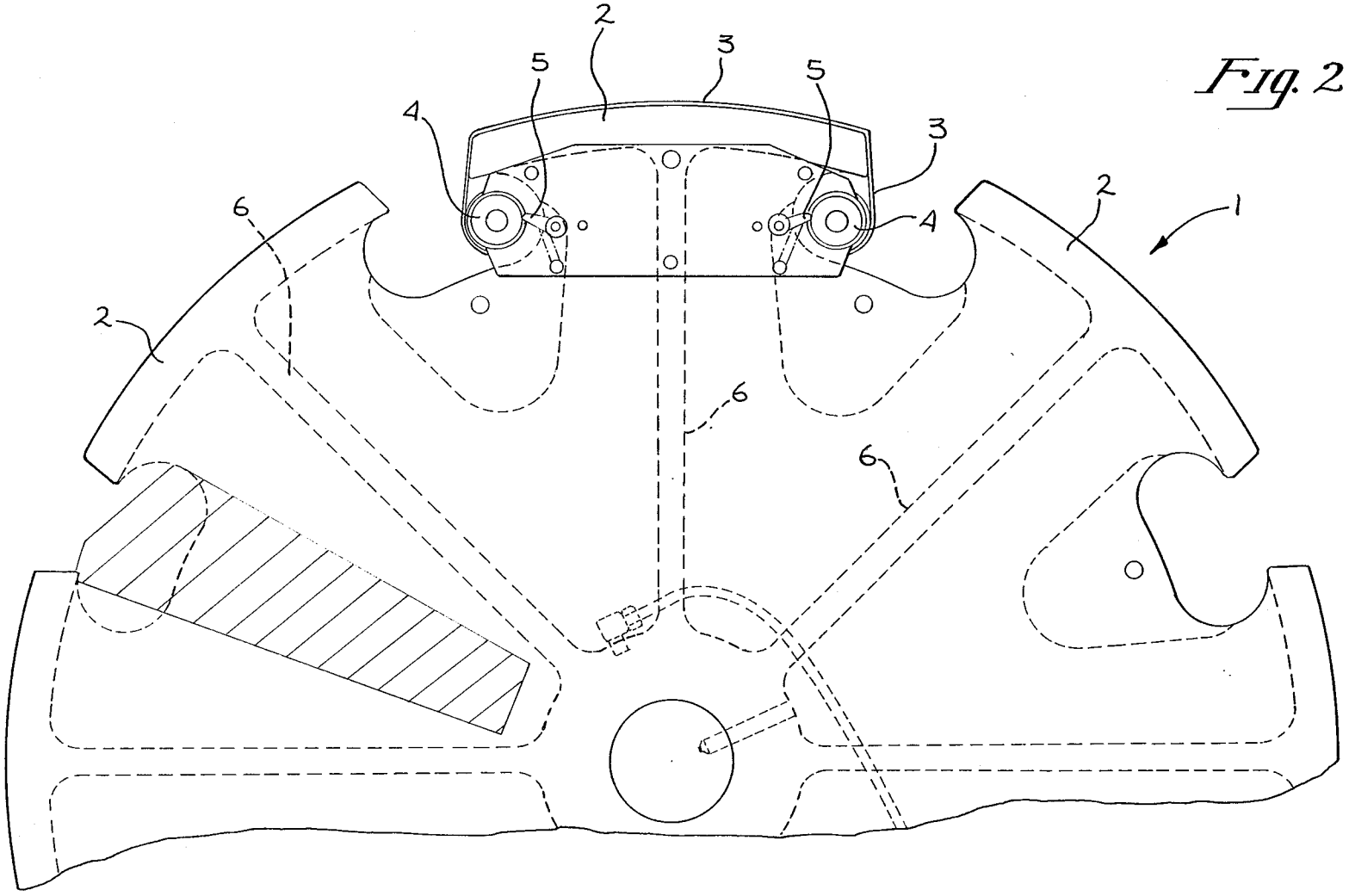
FIG. 2 is a fragmented view to an enlarged scale of a portion of the blanket cylinder shown in FIG. 1 incorporating a diagrammatic representation of a random number printing unit according to the invention.

A typical cylindrical container decorating press has a blanket cylinder (1) of the type shown in FIGS. 1 and 2 which has a number of blanket segments (2) (typically eight segments as shown in the drawing) on which a rubber offset blanket (3) is mounted. The construction of the offset blanket can be more clearly seen in FIG. 2 where it can be seen that the blanket (3) is tensioned over each segment (2) by way of tensioning rollers (4) and pawls (5) to secure the blanket in the desired place over the periphery of the segment.

In a typical can printing process, as each offset blanket passes each inking unit a colour is applied on to the rubber offset blanket. Eventually up to six colours are applied to each blanket. Depending on the precise design of the cylindrical container decorating press, the container to be printed is rotated past the blanket cylinder and all six colours are applied to the container as it is rolled against the blanket. The container is subsequently varnished and dried and the finished product then leaves the cylindrical container decorating press.

The blanket cylinder is typically constructed of cast steel and is basically hollow except for reinforcing splines (6).

According to the invention one or more belt type random number printing units of the type described in my co-pending patent application No. 133,666 filed Dec. 16, 1987 and entitled METHOD AND APPARATUS FOR PRINTING QUASI RANDOM NUMBERS IN A FLEXOGRAPHIC PRESS are inserted into the blanket cylinder between the reinforcing splines (6) in the position shown. Although only one random number printing unit has been shown in FIG. 2, typically there would be one unit provided between each pair of splines (6) arranged to imprint a random number between each pair of adjacent blankets (3).

The basic configuration of the random number printing unit will now be described with reference to FIG. 3. The printing unit comprises an elongate printing plates cylinder (8) and an elongate idler cylinder (9) about which a plurality of belts (10) are entrained. Each belt has a different length which is a multiple of a basic pitch value or gradient and has a plurality of printing plates adhered to its outer surface. Each belt is maintained in tension by its own tensioning roller (11), and the tensioning rollers are of course positioned in different locations due to the different length of the belts (10).

The belts have internal transverse teeth incorporated into the belt design, and the printing plate roller (8) has geared teeth thereon which mesh with the internal teeth on the belts and keep all of the belts in register as they pass over the printing plate roller (8).

The printing plate roller (8) is driven by a cam drive which rotates the roller, and hence advances each of the belts, by the gradient length or value between each printing operation. The plates attached to the belts typically incorporate number segments which continuously change in register with one another, so that the entire number printed by each segment is constantly changing in a quasi random fashion.

Figure 3:
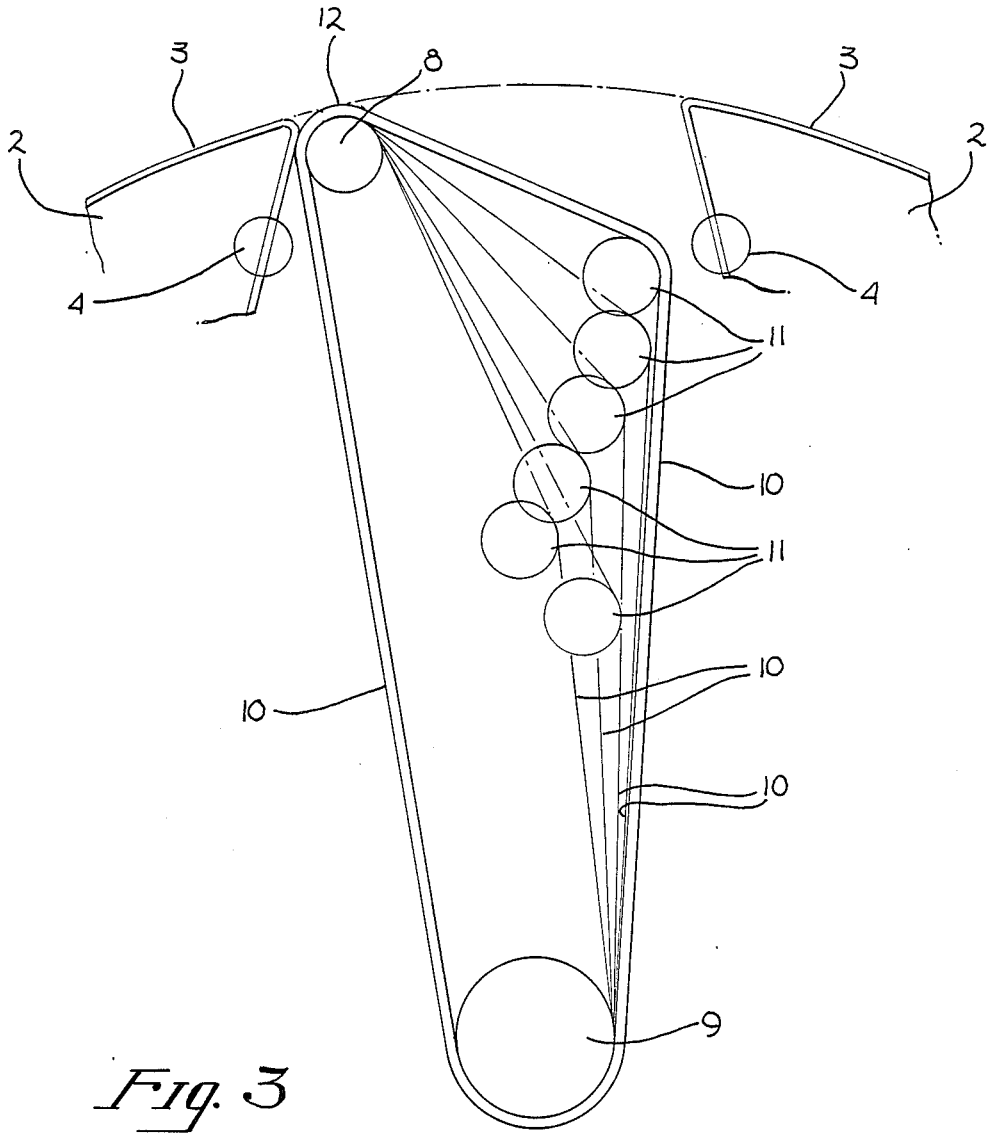
FIG. 3 is an end view of the random number printing unit incorporated into the blanket cylinder.

The ink application system of the cylindrical container decorating press is utilized to apply ink via an offset plate to the flexographic plates on the printing belts (10), which in turn applies the ink to the container rolled against the blankets (3) as the container continues to roll over the surface of the printing plate cylinder at position (12) (FIG. 3).

After one can or other cylindrical object being printed has passed over the printing plate cylinder, the cylinder is rotated by a cam through one gradient and a new combination of numbers is then presented ready to be inked and for the cycle to be repeated. There are eight different random number printing units arrayed around the blanket cylinder and each unit will print approximately thirty-one million different combinations of game components before repeating a combination.

In this manner an apparatus is provided which enables random numbers to be printed on to cans or other cylindrical objects for the playing of games of chance in a simple and yet effective manner.

Figure 4:
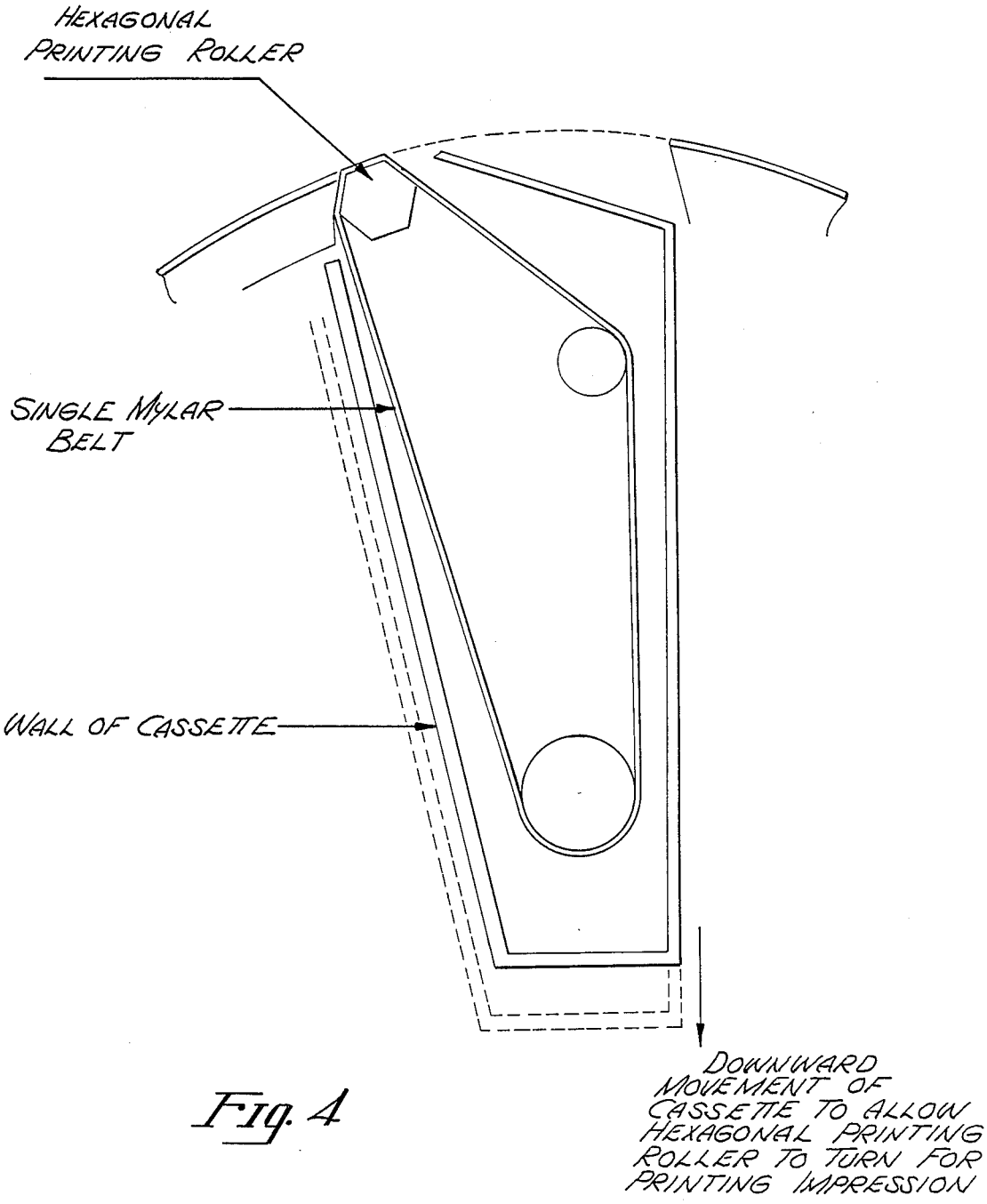
FIG. 4 is an end view of an alternate embodiment of the present invention.
Figure 5:
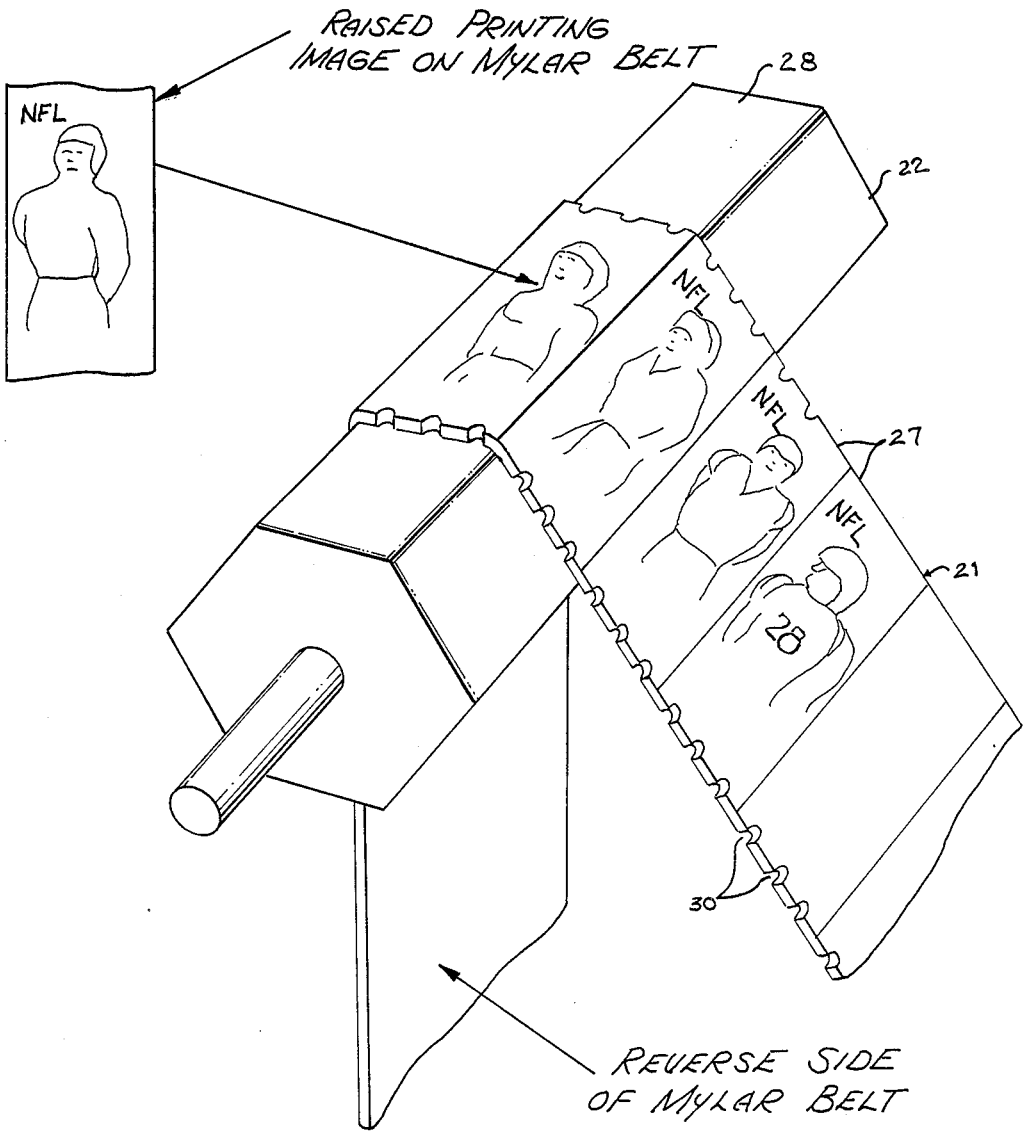
FIG. 5 is a perspective view of a blanket segment of FIG. 4.

An alternate embodiment of the printing unit of the present invention is illustrated in FIGS. 4 and 5: Referring first to FIG. 4, a side view of the printing unit is illustrated. In this embodiment, a single belt 21 is entrained about an idle cylinder 9, a tensioning roller 11 and a hexagonal printing plate cylinder 22. The belt assembly is contained within a housing 25, which can be moved up and down within the opening 24 in the printing press. The entire housing and belt assembly is referred to herein as a cassette unit. The up/down movement of the cassette unit permits the hexagonal printing plate cylinder 22 to be turned for advancing the belt 21 to the next printing image. In this embodiment, each cassette unit contains a single impression belt. A plurality of cassette units having belts of different lengths may be disposed about the printing press as desired.

Referring now to FIG. 5, a perspective view of the printing belt 21 is shown. The belt 21 includes a plurality of sections 27 registered with a face 28 of the printing plate cylinder 22. The belt includes a plurality of openings 30 for engaging pins or sprockets on tensioning roller 11. The belt 21 may contain number tables as described above or any decorative image desired. The use of this cassette unit, which may be removably coupled to a standard can decorator press, permits the easy addition of images to a can without retooling the blanket segments. In addition, the cassette unit is easily removable and the belt 21 easily changed to allow great flexibility in providing images on cans and other cylindrical objects.

The present invention has particular application to the printing of promotional items such as games, collectable figures, celebrities, etc. onto cans and other cylindrical objects. One particular application of the present invention is with the use of thermochromic ink, i.e. ink whose color is temperature dependent. For example, a promotional game or picture could be printed onto a cup or can with thermochromic ink so that when a chilled drink was poured into the cup or the can was chilled, a prize indication or other item would appear.

Similarly, the present invention is particularly applicable to a game relying on the quasi-random nature of the number tables printed by the assemblies of the present invention. For example, each can is printed with a quasi-random number and/or bar code. A sponsoring company could select "winning" numbers periodically and could give a prize to anyone turning in the can having the correct number. Such promotions could be particularly useful in improving the ecology as an incentive to users of canned goods to turn them into recycling centers.

CAN PRINTING GAME

The apparatus of the present invention has particular application to recyclable cans such as soft drink cans, etc. Certain states now require that deposits be paid by a consumer when purchasing goods stored in recyclable cans. The deposit is returned to the consumer when empty cans are brought back to the point of purchase or to a recycling center. The amount of the deposit is designed to encourage the original purchaser to return the can for recycling. It also acts as an incentive for others to collect recyclable cans to submit for deposit money.

The present invention proposes an additional incentive for both purchase and recycling of recyclable cans. The present invention contemplates the printing of pseudo-random numbers, symbols or other indications onto cans. In the preferred embodiment of the present invention, a random or pseudo-random number is included as part of the universal product code (UPC). The UPC is a series of lines or bars printed on the can representing a number which is otherwise unreadable to a member of the general public. The UPC must be scanned and decoded in order to convey information.

Figure 6:
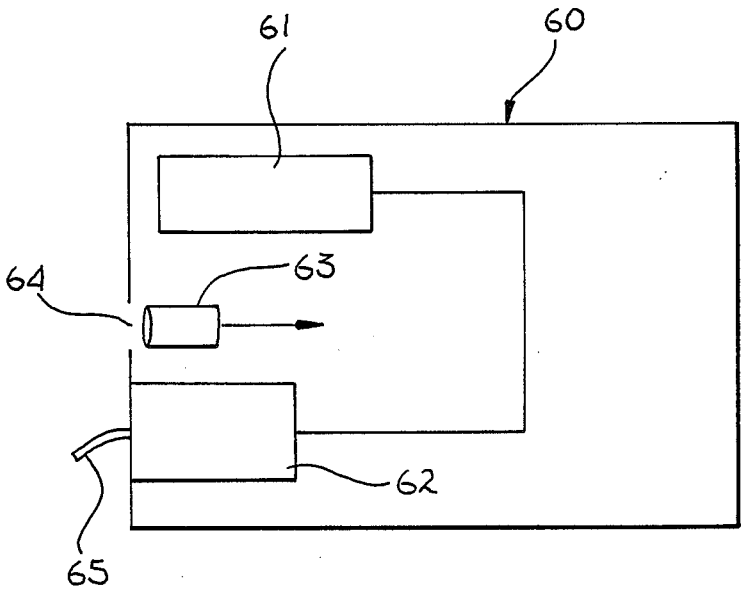
FIG. 6 is a block diagram of a reverse vending machine.

The present invention contemplates self service recycling centers utilizing what is commonly referred to as a "reverse vending machine". A reverse vending machine accepts empty cans and returns deposit money to the user. One such reverse vending machine is manufactured by Invipco and is shown in general form in FIG. 6. The reverse vending machine 60 includes an opening 64 in a housing 66 for insertion of a can 63. The optical scanning Unit 61 is used to scan the UPC of the can. In some instances, processing means are included to track the number of cans from each manufacturer inserted into the reverse vending machine so that accurate allocations of deposit costs may be maintained. The optical scanner 61 may be of any suitable type in use at the present time. The operation of the optical scanning device 61 is not discussed in detail here since such devices are well known in the art. A printer 62 is coupled to the scanning unit 61. The printer 62 prints out a tape 65 providing the user with the number of cans deposited, as well as a list of the game numbers contained in the UPC of the cans inserted. The printout tape 65 is provided to the user for his records.

Periodically, a winning number or numbers are drawn or otherwise determined by a sponsoring company. Prizes are awarded to holders of receipts indicating that they returned a can with the "winning" number to a reverse vending machine or recycling center. One advantage of including the game numbers as part of the UPC is that they are otherwise unreadable, so as to discourage people from discarding cans that do not contain a winning number. Consumers are encouraged to turn in all cans to learn if a can includes a winning number.

In other instances, the winning combination could be determined in advance, and a pseudo-random distribution of numbers is utilized so that only a certain number of cans will contain winning numbers. This is similar to well known "lottery" type games in which a large number of plays contain numbers for a small prize amount with decreasing numbers of plays containing numbers for larger prize amounts. Although the present invention has been described in terms of cans, it has equal application to any cylindrical items.

Thus, an improved method and apparatus for printing onto cylindrical objects has been described.

I claim:

1. A method of printing random numbers on cylindrical objects in a decorating press having a blanket cylinder with a plurality of blanket segments comprising the steps of:

(a) disposing a printing unit comprising at least two unequal length belts having flexographic printing plates thereon entrained about a printing plate cylinder between two of said blanket segments;

(b) applying ink to said printing plates;

(c) rotating a cylinder against said blanket segments and said printing plate cylinder such that a pattern of said flexographic plates disposed over said printing plate cylinder is transferred to said cylinder;

(d) advancing said unequal length belts through one increment;

(e) repeating steps (c) and (d).

2. The method of claim 1 wherein said unequal length belts are maintained in tension over a plurality of tension rollers.

3. The method of claim 1 wherein said unequal length belts are each a multiple of a basic pitch value of said printing plate cylinder.

4. The method of claim 1 wherein said unequal length belts are each a prime multiple of a base pitch value of said printing plate cylinder.

5. A method of providing a recyclable can comprising the steps of:

printing a game number onto said can as part of a universal product code (UPC) symbol;

said game numbers printed onto said can in a decorating press having a blanket cylinder with a plurality of blanket segments by the steps of:

(a) disposing a printing unit comprising at least two unequal length belts having flexographic printing plates thereon entrained about a printing plate cylinder between two of said blanket segments;

(b) applying ink to said printing plates;

(c) rotating a cylinder against said first and second blanket segments and said printing plate cylinder such that a pattern of said flexographic plates disposed over said printing plate cylinder is transferred to said cylinder;

(d) advancing said unequal length belts through one increment;

(e) repeating steps (c) and (d)

scanning said game number with an optical scanner when said can is submitted to a reverse vending machine;

printing said game number onto a receipt when said can is submitted to a reverse vending machine and providing said receipt to a user of said machine;

determining a winning number and providing a prize to said user when said winning number matches said game number.

6. The method of claim 5 wherein said reverse vending machine comprises a housing, receiving means disposed within said housing for receiving said can, said optical scanner disposed within said housing for scanning said UPC symbol and determining said game number, and printing means coupled to said scanning means for printing out said determined game number.

* * * * *